US009008343B2

(12) United States Patent
Dimitrov

(10) Patent No.: US 9,008,343 B2
(45) Date of Patent: Apr. 14, 2015

(54) ANNULAR DIAPHRAGM COMPRESSION DRIVER

(71) Applicant: Dimitar Kirilov Dimitrov, Sofia (BG)

(72) Inventor: Dimitar Kirilov Dimitrov, Sofia (BG)

(73) Assignee: BMS Speakers GmbH, Hannover (DE)

( * ) Notice: Subject to any disclaimer, the term of this patent is extended or adjusted under 35 U.S.C. 154(b) by 0 days.

(21) Appl. No.: 13/799,453

(22) Filed: Mar. 13, 2013

(65) Prior Publication Data

US 2013/0243232 A1 Sep. 19, 2013

(30) Foreign Application Priority Data

Mar. 15, 2012 (DE) ..... 10 2012 102 207

(51) Int. Cl.
*H04R 1/32* (2006.01)
*H04R 1/30* (2006.01)

(52) U.S. Cl.
CPC ..... *H04R 1/323* (2013.01); *H04R 1/30* (2013.01); *H04R 2400/13* (2013.01)

(58) Field of Classification Search
CPC ..... H04R 1/30; H04R 1/323; H04R 1/345; H04R 2400/13; G10K 9/13; G10K 9/22; G10K 13/00
USPC ..... 381/186, 335, 337, 340, 342, 343, 387, 381/338; 181/177, 182, 183, 185, 189
See application file for complete search history.

(56) References Cited

U.S. PATENT DOCUMENTS 4,091,891 A * 5/1978 Hino et al. ..... 181/185
4,325,456 A * 4/1982 Ureda ..... 181/159
5,875,252 A * 2/1999 Lesage ..... 381/340
6,320,970 B1 * 11/2001 Czerwinski et al. ..... 381/343
6,557,664 B1 * 5/2003 Andrews et al. ..... 181/152
8,036,408 B2 * 10/2011 Voishvillo ..... 381/343
8,718,310 B2 * 5/2014 Adams ..... 381/340
2010/0006367 A1 * 1/2010 Bartlett ..... 181/187

(Continued)

FOREIGN PATENT DOCUMENTS

EP 0793216 2/1997

OTHER PUBLICATIONS

Voishvillo, A., "Dual Diaphragm Compression Drivers", Audio Engineering Society Convention Paper presented at the 131st Convention, (Oct. 20-23, 2011), 12 pages, p. 1, lines 30-32.

*Primary Examiner* — Curtis Kuntz
*Assistant Examiner* — Joshua A Kaufman
(74) *Attorney, Agent, or Firm* — Whitham Curtis Christofferson & Cook, PC

(57) ABSTRACT

An annular diaphragm compression driver for electro-acoustic conversion has an annular diaphragm, which bears a moving coil, and a compression driver housing with a closed housing base. Opposite the housing base is a sound wave routing element having a sound discharge channel. The compression driver also has an annular magnet system unit, which has an annular magnet gap (M) and a compression chamber, adjoining the magnet gap (M), for the annular diaphragm. The open exit end of the sound discharge channel is in slot form and its entry start is annular. The sound path between the compression chamber and the entry start contains an annular collecting space. The collecting space and the sound discharge channel contain a central sound guidance body having a portion which merges to match the slot-like exit end. The sound discharge channel is formed between the sound guidance body and the sound wave routing element.

10 Claims, 19 Drawing Sheets

(56) References Cited

U.S. PATENT DOCUMENTS

2010/0329495 A1* 12/2010 Wendell et al. ..... 381/343
2011/0085692 A1* 4/2011 Voishvillo ..... 381/343
2012/0033841 A1* 2/2012 Donarski ..... 381/340

* cited by examiner

SECTION W-W

SECTION W-W

SECTION W-W

SECTION W-W

SECTION W-W

ANNULAR DIAPHRAGM COMPRESSION DRIVER

BACKGROUND OF THE INVENTION

The invention relates to an annular diaphragm compression driver for electro-acoustic conversion having an annular diaphragm, which bears at least one moving coil, having a compression driver housing, which a closed housing base, opposite the housing base a sound wave routing element having a sound discharge channel which is open at the end, and having at least one annular magnet system unit having an annular air gap and having a diaphragm holding space, adjoining the air gap, for an associated annular diaphragm.

Such annular diaphragm compression drivers are also called pressure chamber drivers and are provided for implementing a horn loudspeaker.

DESCRIPTION OF RELATED ART

Annular diaphragm compression drivers are known from DE 196 26 236 C2, for example. They have a moving coil, which can move in an annular magnet gap in a magnet system, an annular diaphragm, which is driven by the moving coil, and a compression chamber which is of annular design and which is connected over its perimeter to a central sound exit channel. In the direction of radiation in front of the diaphragm, a partition may be provided which tightly seals the space in front of the diaphragm with respect to the sound exit channel, but has radial slots. This forms an acoustic lens, which can be used to guide sound from all the diaphragm parts to the output of the compression driver and hence to the input of a connected horn with minimum loss.

US 2011/0085692 A1 discloses a dual compression driver having two diaphragms which are opposite one another and which are connected to a rotationally symmetrical sound discharge channel via channels which are distributed radially over the perimeter.

This technology is also described in detail in A. Voishvillo: "Dual Diaphragm Compression drivers" in: Audio Engineering Society Convention Paper, 131st Convention, October 20 to 23, 2011, New York, USA.

In addition, U.S. Pat. No. 4,325,456 discloses a compression driver in which an annular diaphragm adjoins a sound guidance portion which has a conically tapering sound feed body. The sound feed body is rotationally symmetrical and has radial channels on the outer face which extend in the sound exit direction from the diaphragm in a direction of the open end of the compression driver. Arranged thereafter is a conically expanding horn of circular cross section.

EP 0 793 216 A2 discloses a pressure chamber driver having one or two diaphragms and a pressure chamber which is of annular design and which is connected over its perimeter to a central sound exit channel. The pressure fluctuations formed in the pressure chamber are transmitted via a gap-like channel to a region of a conical base of a sound exit channel of sack-like design.

US 2012/0033841 A1 discloses an annular diaphragm compression driver which has a compression driver housing and a sound routing element which can be connected thereto. The compression driver housing has a central frustoconical sound guidance body which likewise projects into a depression in the sound wave routing element. The sound wave routing element has a plurality of sound discharge channels which each have a quadrangular cross section which merges from a quadrangular cross section that is curved in circle segment form into a rectilinear rectangular cross section.

One problem in the case of these conventional annular diaphragm compression drivers is that of providing a defined sound wavefront at the exit end of the sound discharge channel.

SUMMARY OF THE INVENTION

The object is achieved by means of the annular diaphragm compression driver having a central sound guidance body in the collecting space and a sound discharge channel which merges from an annular cross section into a linear cross section which matches the slot-like sound exit end of the sound discharge channel.

The annular diaphragm compression driver has a slot-like, open sound exit end of the sound discharge channel. This has the advantage that a defined flat or curved coherent sound wavefront is radiated. The sound wave is matched from the annular diaphragm to the slot-like sound exit end by using the sound discharge channel with an internal central sound guidance body. The sound guidance body has an annular cross section which may preferably be rotationally symmetrical, but may optionally also be elliptical or polygonal or the like, for example. In the direction of the sound exit end of the sound discharge channel, the annular cross section merges into a linear cross section which matches the slot-like exit end of the sound discharge channel. In this case, the sound discharge channel is formed between this central sound guidance body and the circumferential wall of the sound wave routing element by virtue of the circumferential outer wall of the central sound guidance body forming the inner wall of the collecting space and the inner wall of the sound discharge channel.

An annular collecting space between the diaphragm holding space and the sound discharge channel, and the central sound guidance body situated in the collecting space and at least in part also in the sound discharge channel, are able to be used to reshape the sound wave produced by the annular diaphragm such that said sound wave exits the slot-like sound exit end of the sound discharge channel correctly and hence without distortion with a desired flat or curved wavefront phase. In practice, the contour of the collecting space and of the adjoining sound discharge channel can be matched to the respective embodiment of the annular diaphragm compression driver such that, as necessary, a planar, convex or concave wavefront is achieved at the slot-like output of the open sound exit end. For this purpose, the sound paths respectively covered from the compression chamber to the slot exit at the slot-like sound exit end are achieved.

The compression chamber holds the moving diaphragm such that the moving coil of the diaphragm enters the annular magnet gap in the magnet system unit and can be deflected by the magnet system of the magnet system unit. The annular diaphragm is firmly clamped in the compression chamber on the inside and outside, i.e. in the internal radius and the external radius, by the compression driver housing. In this case, the space for holding the diaphragm acts as a compression chamber in which the air in the compression chamber is compressed by the deflection of the diaphragm, and the resultant sound pressure is routed away to the outside via the collecting space and the sound discharge channel.

In practice, the sound wave routing element is preferably a separate housing part which has a circumferential wall and also a flange to screw it to the annular magnet system unit and that part of the compression driver housing which contains the diaphragm. The circumferential wall then forms the outer wall of the sound discharge channel, and the central sound guidance body inserted into the space which bounds by the circumferential wall forms the inner wall of the sound discharge channel.

Between the level of the flange connection of this sound wave routing element and the annular compression chamber along with its channels and slots, an annular collecting space is provided which is likewise bounded at least in part on the inside by the sound guidance body. The channels or slots in the compression chamber are therefore not guided into the sound output channel directly but rather are first of all guided into a collecting space.

In this collecting space, the sound waves exiting the compression chamber are first of all mixed and guided over a first length, said mixing and guiding then being continued from an annular to a slot-like waveform with the desired wavefront in the sound output channel.

In one embodiment, the at least one compression chamber opens into the collecting space via a radially circumferential channel.

However, it is particularly advantageous if at least one compression chamber opens into the collecting space via a multiplicity of slots which are bounded by side walls. This has the advantage that the slots can be used to perform phase matching over a defined frequency range of the annular diaphragm compression driver. The arrangement of individual channels bounded by side walls between the compression chamber and the collecting space allows efficiency to be increased and frequency reproduction to be improved. In this case, the channels may have the same length or preferably different lengths, in order to use the different lengths to equalize propagation time differences for different frequencies in the frequency range.

It is particularly advantageous if two compression chambers having associated annular magnet system units are arranged above one another such that the moving coils of the two diaphragms held in a respective compression chamber point away from one another. The compression chambers then open into the common collecting space via channels or slots which are delimited from one another.

Hence, two isolated compression chambers are formed and the sound is combined in the collecting space. This collecting space then serves as a mixing space in which the sound waves exiting the compression chamber are first of all mixed in the correct phase and are then transferred from the annular cross section to a slot-like cross section via the sound discharge channel. If the diameter of the diaphragms is approximately the same, the two compression chambers and diaphragms arranged thereon can be used to increase the sound pressure, or if the diameter of the diaphragms is different, a larger frequency range can be attained.

Preferably, a further compression chamber having an annular third magnet system unit is arranged adjacent to the housing base. In that case, the compression chamber of the third magnet system unit opens directly into the collecting space. In this way, it is possible to produce a very compact compression driver having three diaphragms, in which not only are the mutually opposite upper two compression chambers and diaphragms used to achieve a high sound pressure, but also the third diaphragm—which preferably has a smaller diameter—can be used to increase the frequency range or to improve the sound reproduction quality even for high frequencies using the third diaphragm.

In turn, the collecting space can be used to combine the sound waves correctly in terms of their phase and, in order to achieve a desired planar, convex or concave wavefront at the slot-like sound exit, to transfer them from the annular waveform to the slot-like waveform.

In one preferred embodiment, the collecting space is annular over its entire length, as is the sound guidance body over its length which is situated in the collecting space. The collecting space is preferably rotationally symmetrical, but may also have a cross section which is elliptical, polygonal or the like.

In one preferred embodiment, the sound exit end, which is open in slot form, has a cross section which is rectangular. The slot shape is achieved by virtue of the longitudinal edges of the rectangular opening of the sound exit end being substantially longer than the transverse edges.

Alternatively, it is conceivable for the slot shape to be achieved by virtue of an opening in the form of a biconvex lens in the sound wave routing element. In this case, two curved longitudinal edges which are opposite one another are provided, the ends of which run into one another at an acute angle.

Alternatively, it is also conceivable for the slot shape of the open sound exit end to be achieved by virtue of an elliptical opening, in the case of which the longitudinal edges of the upper end of the sound wave routing element are curved and then merge into one another with a curvature having a substantially smaller radius than the radius of the curved longitudinal edges at the ends which are opposite one another. The term "slot-like" is therefore understood to mean not only a pure linear or rectangular opening but also curved openings having an opening length which is substantially larger than the opening width.

The collecting space preferably has a tapering or widening portion. The effect advantageously achieved by this is that in this intermediate region it is possible for the sound wave to be deformed and for propagation times to be matched on the basis of need. The phase coherency of the compression driver can be improved in this way.

In one suitable embodiment, it is conceivable for the collecting space to be divided into segments by partitions. In this case, channels likewise formed by partitions may be provided from the compression chamber. The division of the collecting space into segments may match the channels, but should preferably be different from the division of the channels in the segmented split.

BRIEF DESCRIPTION OF THE DRAWINGS

The invention is explained in more detail below using exemplary embodiments with reference to the appended drawings, in which.

DETAILED DESCRIPTION OF THE INVENTION

Figure 1A:
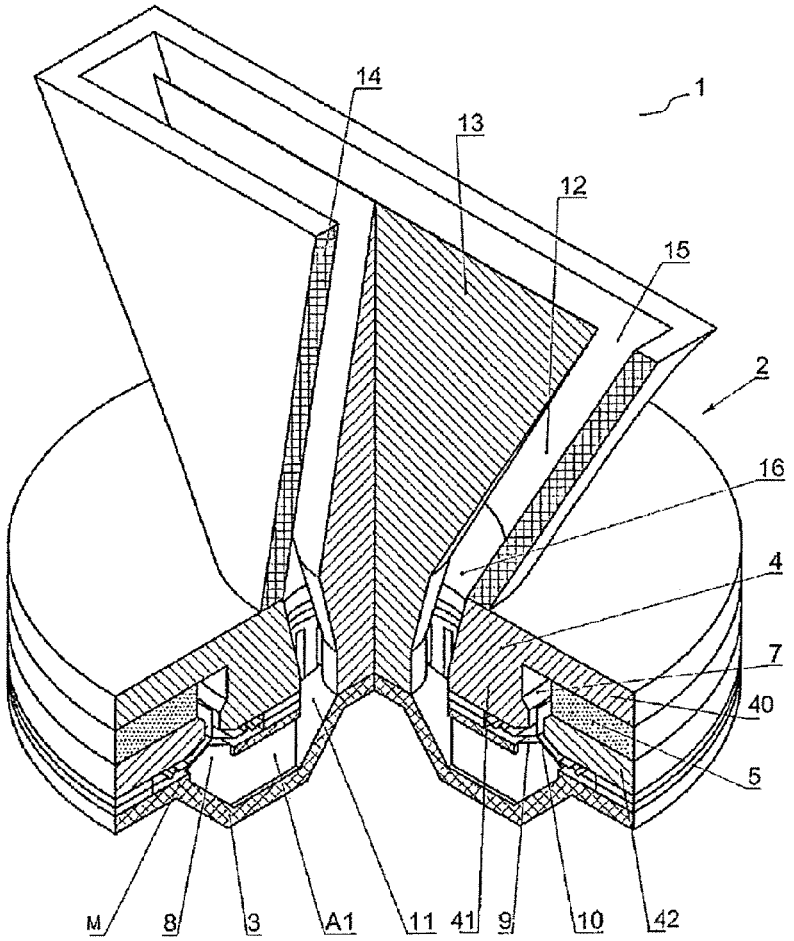
FIG. 1*a*)—shows a perspective view of a first embodiment of an annular diaphragm compression driver.
Figure 1B:
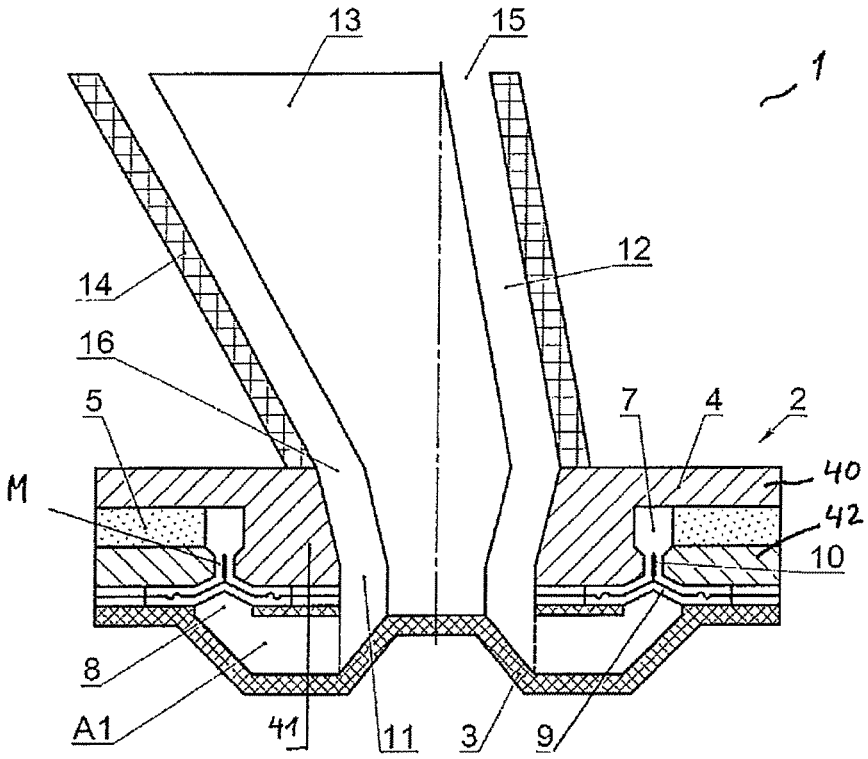
FIG. 1*b*)—shows a cross-sectional view of the annular diaphragm compression driver from FIG. 1*a*)

FIG. 1*a*) shows a first exemplary embodiment of an annular diaphragm compression driver 1 in a perspective view, and FIG. 1*b*) shows it in the cross-sectional view. The annular diaphragm compression driver 1 has a compression driver housing 2 having a housing base 3 and an annular magnet system unit 4, which adjoins the housing base 3. The magnet system unit 4 has an annular magnet 5 in the form of a permanent magnet, a magnet routing element, which comprises a first pole plate 40 (also called lower pole plate), an adjoining pole core 41 and a second pole plate 42 (also called upper pole plate), and also a magnet gap M. This forms a closed magnet loop. In this case, the magnet 5 is positioned between the first and second pole plates 40, 42. The first (lower) pole plate 40 and the pole core 41 are produced integrally as an integral part.

Alternatively, it is conceivable for the magnet 5 to be produced as an electromagnet by means of coil turns. The annular magnet 5 is embedded in the pole plates 40, 42, which are formed from metal, the second pole plate 42 and the pole core 41 being spaced apart from one another by an annular magnet gap M (air gap). The magnet system unit 4 is formed with the magnet gap M such that the magnetic field produced by the annular magnet system unit 4 is self-contained in the magnet gap M and a closed magnet loop is formed.

Formed between the magnet system arrangement 4 and the housing base 3, there is a likewise annular compression chamber 8 which holds an annular moving diaphragm 9. The diaphragm 9 is clamped on the inside and outside between the magnet system unit 4 and the housing base in a manner which is known per se. The diaphragm 9 is V-shaped and has a protruding web 10, which bears a moving coil, in the central region. The moving coil situated in the magnetic field in the magnet gap M is excited by current flow and then results in the diaphragm 9 being deflected. This is sufficiently well known per se from loudspeakers and particularly pressure chamber drivers. As seen from the compression chamber 8, what is known as the back chamber 7 is situated behind the magnet gap M.

Oscillation of the diaphragm 9 compresses the air which is in the compression chamber 8. This results in a sound pressure, which is routed via a channel A1 into an annular collecting space 11 and from there into a sound discharge channel 12. In the exemplary embodiment shown, the channel A1 is annular and may be essentially or completely open, i.e. not segmented.

Fitted so as to adjoin the housing base 3 is a central sound guidance body 13, the circumferential outer wall of which forms the inner wall of the collecting space 11 and the inner wall of the sound discharge channel 12. The outer wall of the sound discharge channel 12 is formed by a sound wave routing element 14 which adjoins the magnet system unit 4.

The sound discharge channel therefore begins at the lower end of the sound discharge channel 14 and ends at the open sound exit end 15. The lower, open end of the sound wave routing element 14, which end adjoins the magnet system unit 4, forms the sound entry start 16 of the sound discharge channel 12.

It can be seen that the sound guidance body 13 first of all widens in the portion which is situated in the collecting space 11 up to the sound entry start 16 of the sound discharge channel 12 after a portion having a constant diameter. The annular collecting space 11 formed thereby is still annular in this case, and—as shown in the illustrated exemplary embodiment—is preferably of rotationally symmetrical design.

In the sound discharge channel 12, on the other hand, the contour of the sound guidance body 13 and also of the sound wave routing element 14 changes such that there is a transition from an approximately annular (preferably rotationally symmetrical) shape into a slot-like cross section.

Figure 1C:
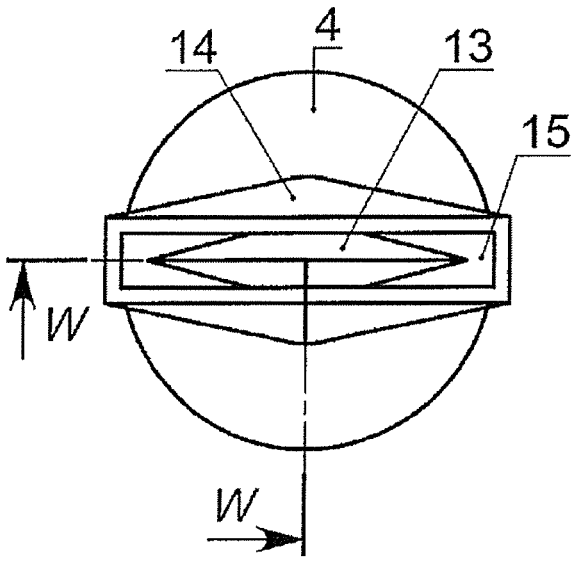
FIG. 1*c*)—shows a front view of the annular diaphragm compression driver from FIG. 1*a*)

This can be seen more clearly from the plan view in FIG. 1*c*).

It is evident that the upper, open sound exit end 15 of the sound discharge channel 12 is in slot form as a result of a corresponding shape of the circumferential wall of the sound wave routing element 14 at the upper end. For this purpose, the circumferential walls of the sound wave routing element 14 are rectangular with two longitudinal edges and, at right angles thereto, transverse edges, the longitudinal edges being substantially longer than the transverse edges.

It is also evident that the central sound guidance body 13 is linear in the upper region so as to match the slot shape, i.e. ends with a more or less narrow, longitudinally extending edge. On the basis of this, the cross section is transferred from the linear shape into an oval or preferably circular cross section. The cross section of the sound guidance body 13 in the region of the sound entry start 16 therefore matches the annular shape, while the cross section of the sound guidance body 13 has a linear form in the region adjoining to the slot-like sound exit end 15.

The plan view in FIG. 1*c*) also shows the annular collecting space 11.

The section lines W and W in FIG. 1*c*) show the section lines from the cross section of the annular diaphragm compression driver 1 that is shown in FIG. 1*b*).

Figure 1D:
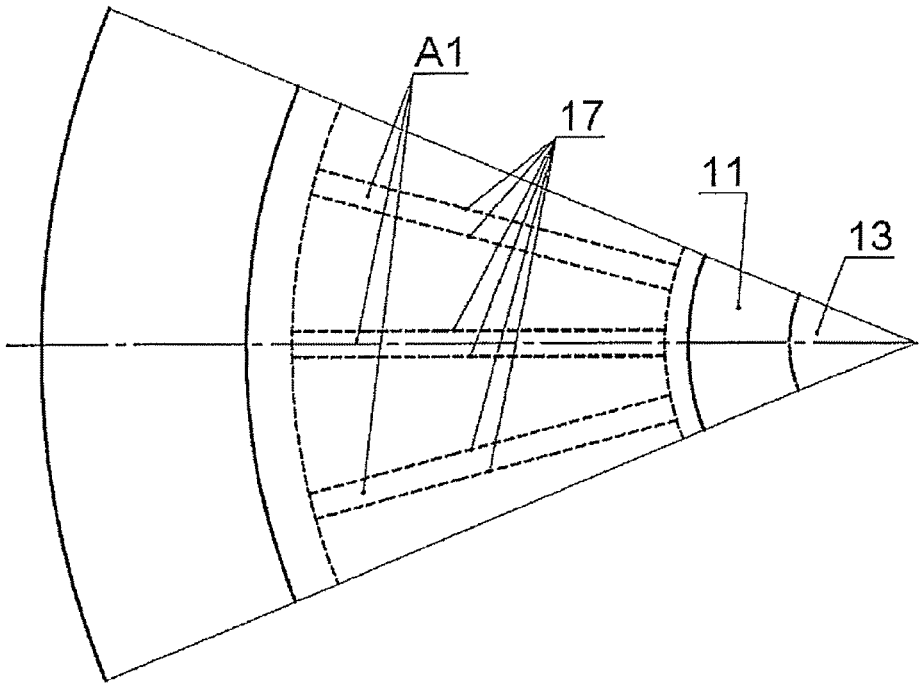
FIG. 1*d*)—shows a partial sectional view through the of an annular diaphragm compression driver in the region of the channels.

FIG. 1*d*) shows a partial sectional view in the region of the annular channel A1 for a modification of the exemplary embodiment from FIGS. 1*a*) and 1*b*).

In this case, a multiplicity of channels A1 are in a distributed arrangement over the perimeter of the pressure chamber driver 1 and are delimited from one another by radially running bounding walls 17.

It can be seen that the radial channels A1 open into the compression chamber 8 at the outer end and into the collecting space 11 at the radially inner end.

Figure 2A:
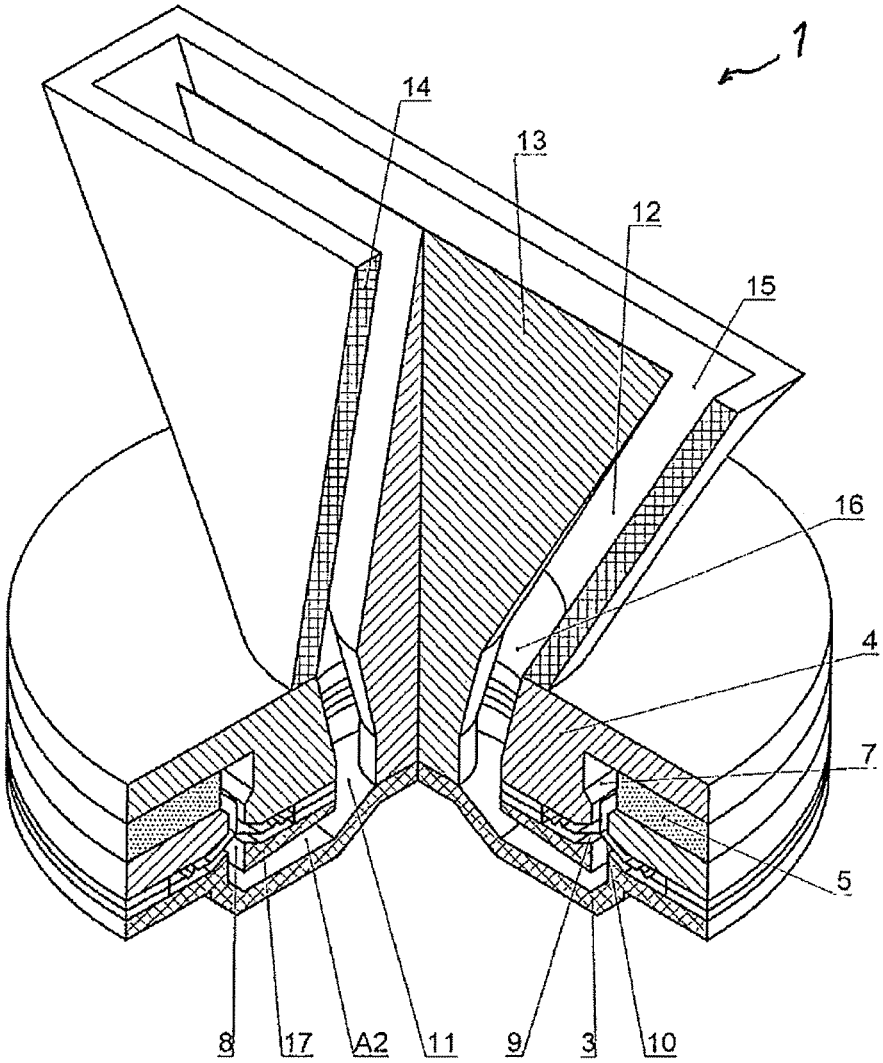
FIG. 2*a*)—shows a perspective view of a second embodiment of an annular diaphragm compression driver.
Figure 2B:
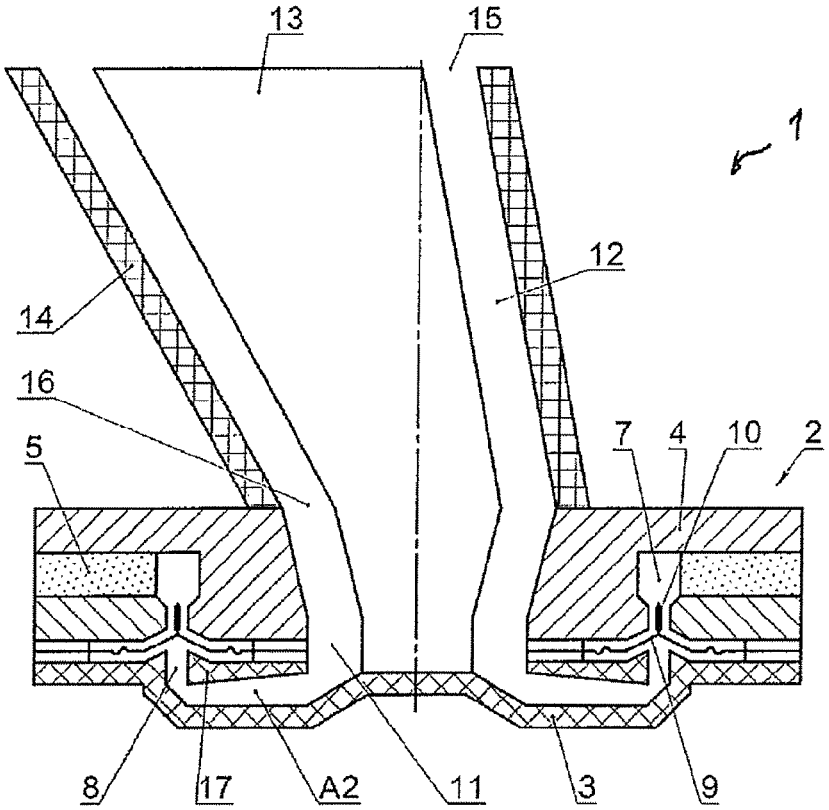
FIG. 2*b*)—shows a cross-sectional view of the annular diaphragm compression driver from FIG. 2*a*)

FIGS. 2*a*) and 2*b*) show a perspective view and a cross-sectional view of a second embodiment of a compression driver 1. In contrast to the first embodiment, the channels A2 are extended in a funnel shape from the compression chamber 8 to the collecting space 11. To this end, the housing wall 17 that is opposite the housing base 3 and that bounds the channel A2 at the top is of inclined design.

In addition, the compression chamber 8 is in a V-shaped form by virtue of inclined walls, and matches the V-shaped diaphragm 9. Openings guided downward to the housing base 3 connect the compression chamber 8 and the associated radially running channel A2.

Otherwise, the remainder of the design of the sound guidance body 13 and of the sound wave routing element 14 is comparable to that in the first exemplary embodiment, which means that reference can be made to the statements in that regard.

Figure 2C:
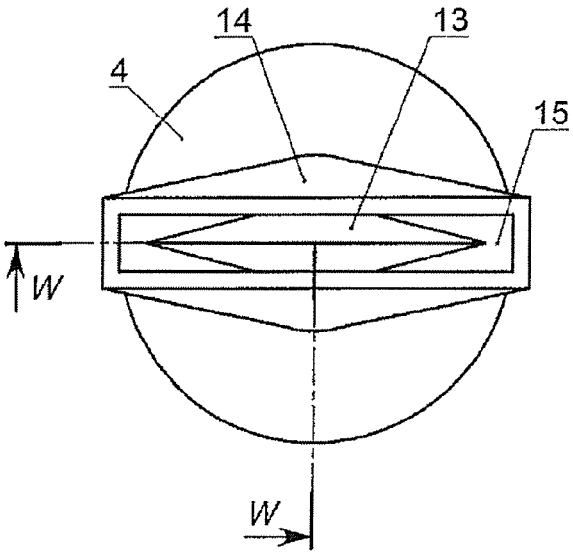
FIG. 2*c*)—shows a front view of the annular diaphragm compression driver from FIG. 2*a*)

The channels A1 may also be produced continuously at the perimeter as an integral channel. The alternative embodiment outlined in FIG. 2*c*), having a multiplicity of channels separated from one another by partitions, is also conceivable.

Figure 3A:
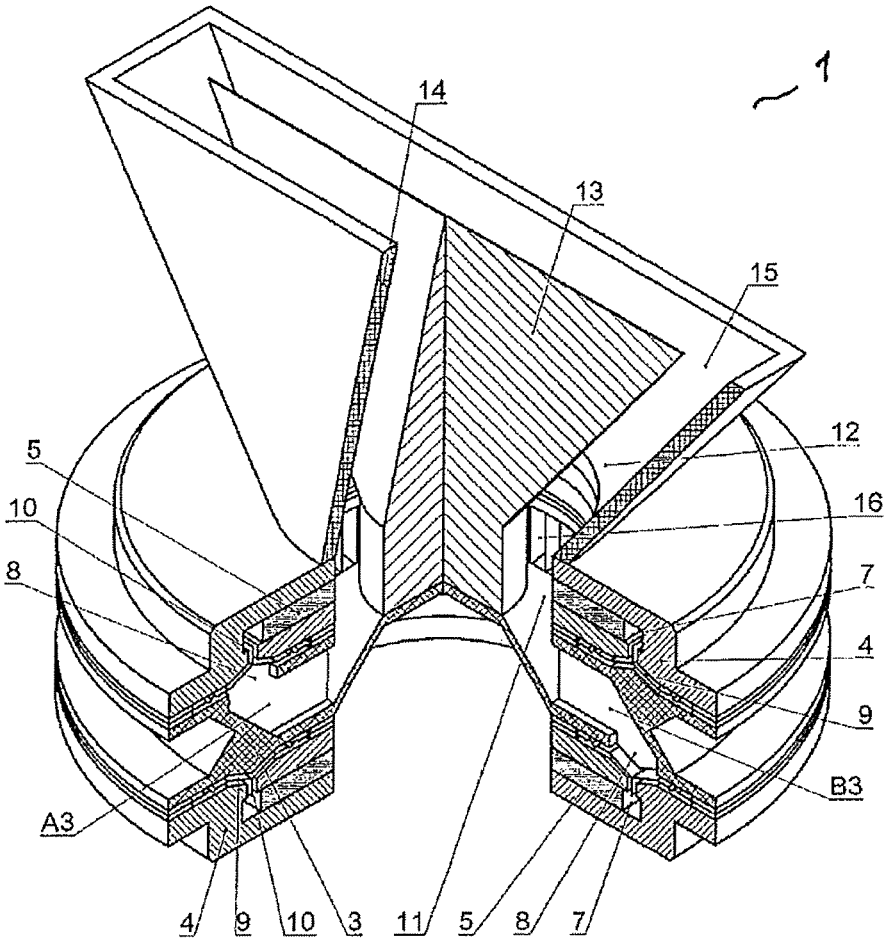
FIG. 3*a*)—shows a perspective view of a third embodiment of an annular diaphragm compression driver.
Figure 3B:
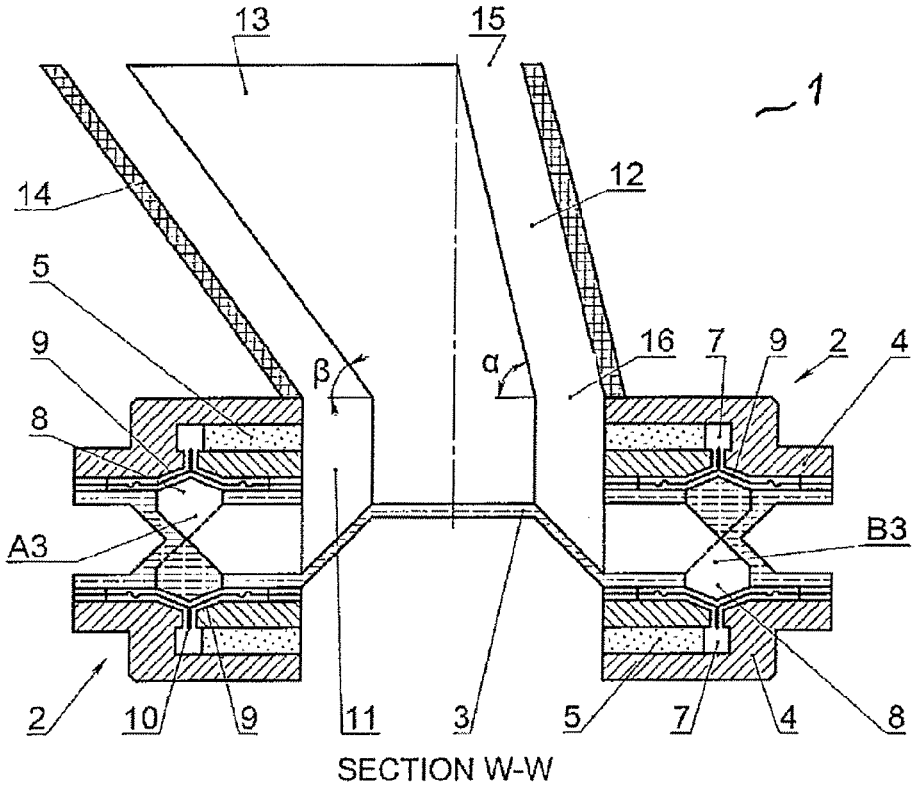
FIG. 3*b*)—shows a cross-sectional view of the annular diaphragm compression driver from FIG. 3*a*)

FIGS. 3*a*) and 3*b*) show a third exemplary embodiment of an annular diaphragm compression driver 1 in perspective and cross-sectional views. In this embodiment, the central sound guidance body 13 is designed to have a constant diameter i.e. a constant cross section, in the region of the annular collecting space 11 over the length in a collecting space from a housing base 3 to the sound entry start 16 of the sound discharge channel 12.

The third embodiment outlines a version of the annular diaphragm compression driver 1 having two annular magnet system units 4 situated above one another with a respective annular diaphragm 9 fitted into an annular compression chamber 8. This increases the sound pressure.

In the exemplary embodiment shown, the diameter of both diaphragms 9 are identical. Hence, the frequency characteristic of both magnet system units 4 with associated diaphragms 9 are almost identical. The channels A3 and B3 of the upper and lower magnet system units 4 are also identical to one another in terms of contour and length, but are of mirror-image design, which means that the sound parts of the two magnet system units 4 are comparable with one another.

The sound exiting the channels A3 and B3 is then collected in the collecting space 11 and deflected upward in the direction of the sound discharge channel 12. In the sound discharge channel 12, the sound wave is then transferred from the rotationally symmetric annular wavefront into a wavefront which matches the slot-like sound exit of the open sound exit end 15.

The contour of the collecting space 11 and of the adjoining sound discharge channel 12 then matches the specific physical shape of the annular diaphragm compression driver 1 such that a desired planar, concave or convex wavefront is achieved at the sound exit end 15.

The angles $\alpha$ and $\beta$ for the inclination of the sound guidance body on the mutually opposite sides are used to outline the possibility—which can likewise be used for all of the embodiments described previously and subsequently—of setting the vertical dispersion. If the angles $\alpha$ and $\beta$ are the same, the vertical dispersion is 0°. A decreasing angle $\beta$, with the result that $\beta<\alpha$, results in an increase in the vertical dispersion, i.e. in a convex radiation angle at the slot exit.

If the angle $\beta>\alpha$, this results in a concave radiation angle in the slot exit.

Figure 3C:
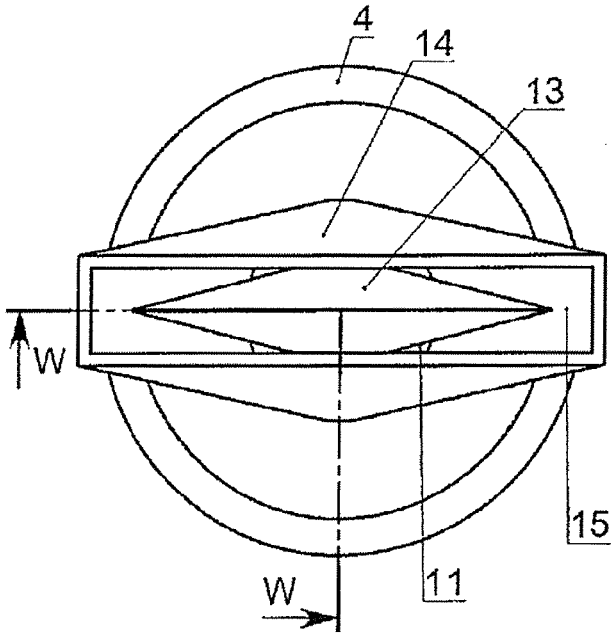
FIG. 3*c*)—shows a front view of the annular diaphragm compression driver from FIG. 3*a*)

FIG. 3*c*) shows a plan view of the third embodiment of the annular diaphragm compression driver 1. This again reveals that the contour of the sound guidance body 13 and of the sound wave routing element 14 results in a transition from a circular or oval rotationally symmetric cross section into a linear cross section which matches the slot-like sound exit end 15.

Figure 3D:
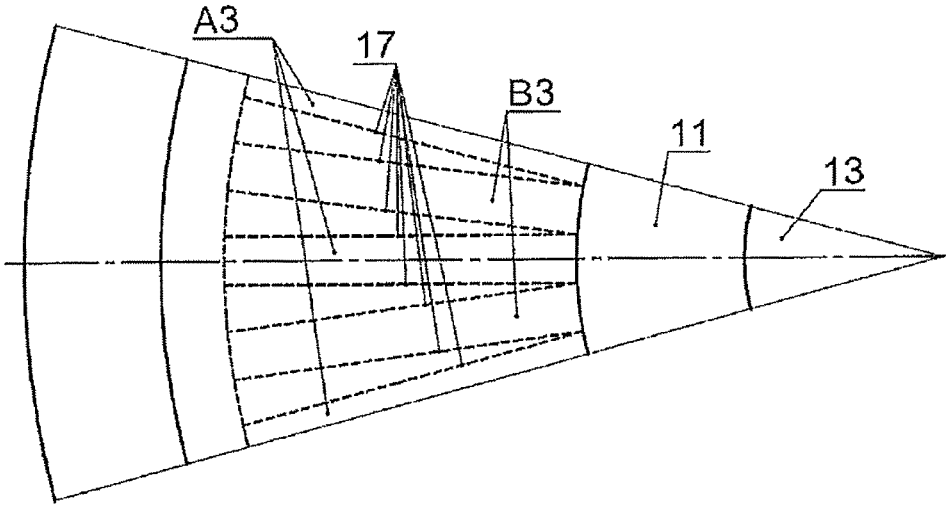
FIG. 3*d*)—shows a partial sectional view through the annular diaphragm compression driver in the region of the channels.

The sectional view through the channels A3, B3 in FIG. 3*d*) reveals that said channels are delimited from one another by means of radially running partitions 17. It can be seen that the channels A3, B3 have a constant width over the radial length.

It is also evident that the channels A3 of the upper magnet system unit 2 are positioned next to one another alternately with the channels B3 of the lower magnet system unit, so that the channels A3, B3 of the upper and lower magnet system units 4 alternate.

Figure 4A:
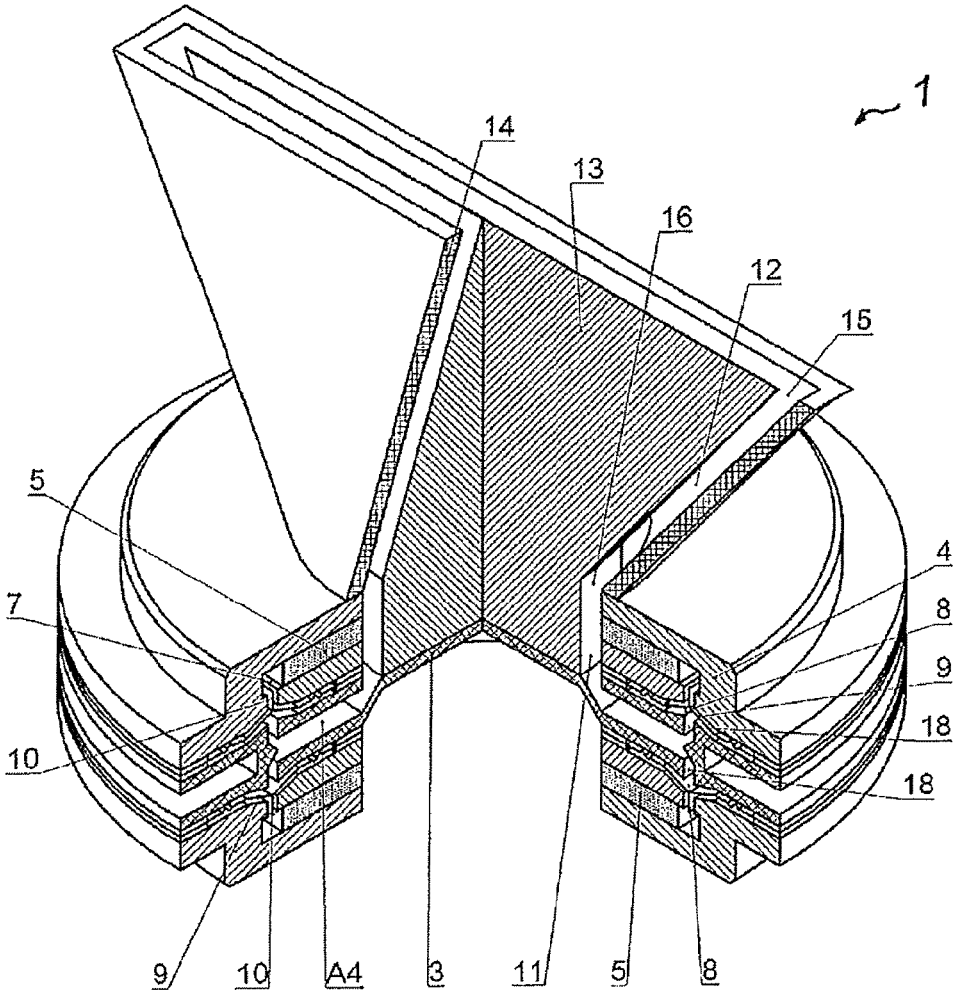
FIG. 4*a*)—shows a perspective view of a fourth embodiment of an annular diaphragm compression driver.
Figure 4B:
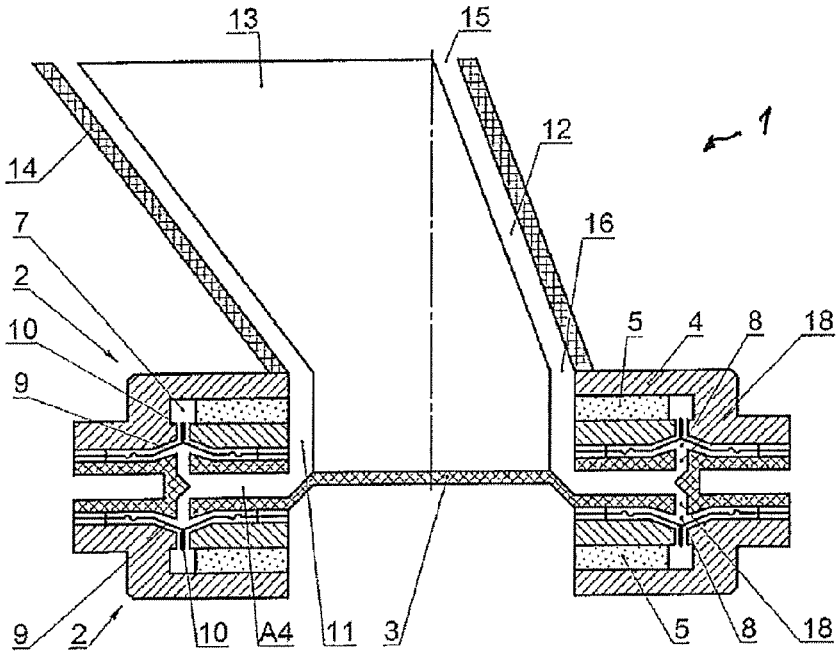
FIG. 4*b*)—shows a cross-sectional view of the annular diaphragm compression driver from FIG. 4*a*)

FIGS. 4*a*) and 4*b*) show a perspective view and a cross-sectional view of a fourth embodiment of an annular diaphragm compression driver 1 in which, again, two magnet system units 4 having respective associated annular diaphragms 9 are arranged above one another.

In this embodiment, the annular compression chambers 8 of the upper and lower magnet system units 4 are connected via openings 18 to a common channel A which is routed radially from the level of the compression chamber 8 inward to the collecting space 11.

This may again be a single circumferential (360°) channel A or a multiplicity of channels that are arranged next to one another and that are spaced apart from one another by partitions.

It is evident that the collecting space 11 is delimited on the inside again by the central sound guidance body 13 which extends from the housing base 3. This sound guidance body 13 has a constant diameter over the length in the collecting space 11. This is adjoined by the sound wave routing element 14 in order to form the sound discharge channel 12 with a contour as already described previously.

Figure 4C:
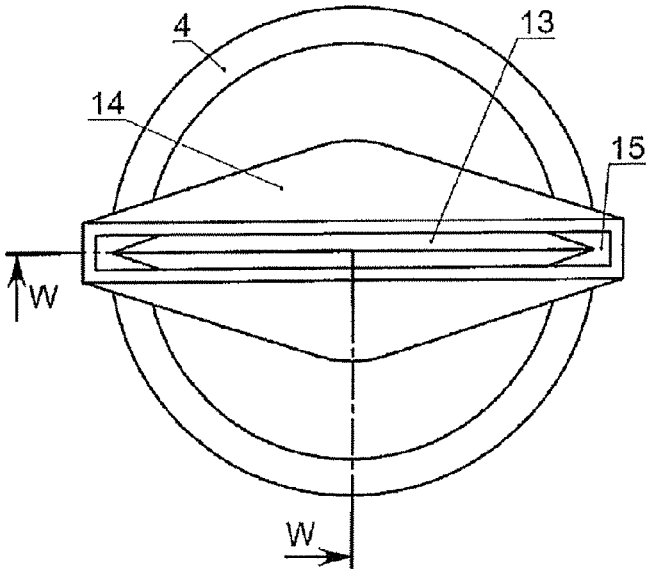
FIG. 4*c*)—shows a front view of the annular diaphragm compression driver from FIG. 4*a*)

This is evident from the contour of the plan view from FIG. 4*c*).

Figure 5A:
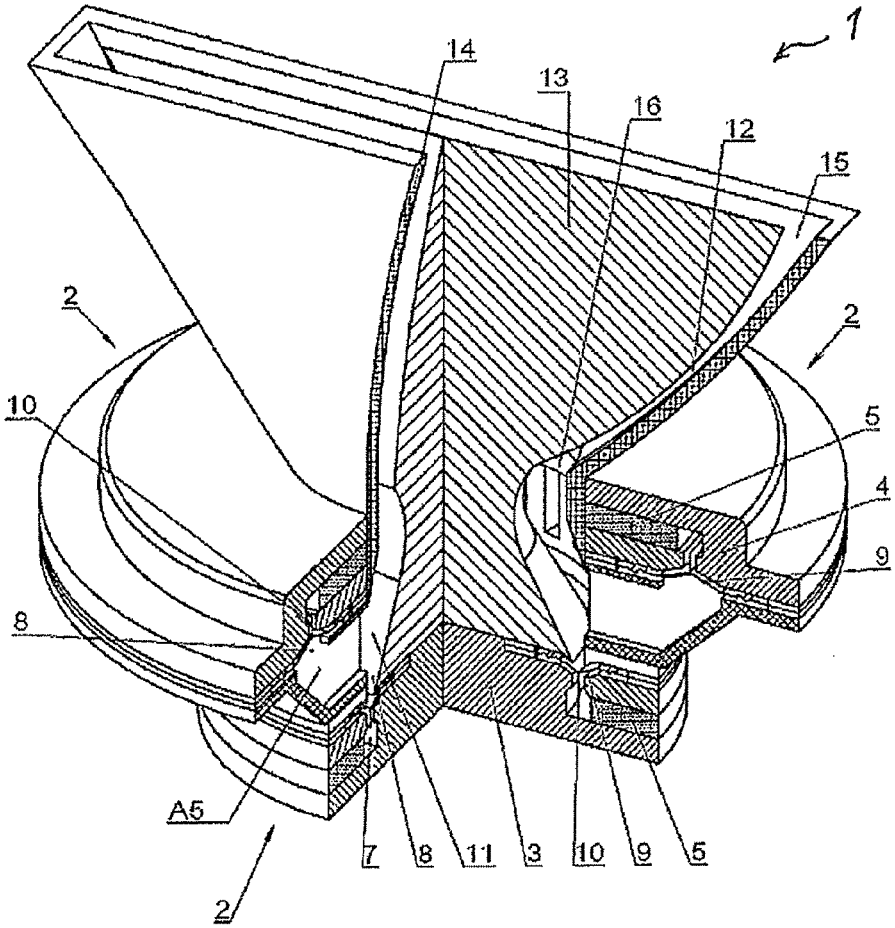
FIG. 5*a*)—shows a perspective view of a fifth embodiment of an annular diaphragm compression driver.

FIGS. 5*a*) and 5*b*) show a fifth embodiment of an annular diaphragm compression driver 1. In this embodiment, the sound guidance body 13 is produced in a form which tapers conically in part in the direction of the sound entry start 16 in the region of the collecting space 11.

In this embodiment, two annular magnet system units 4 are arranged above one another, the upper magnet system unit having a larger diameter than the lower magnet system unit. In particular, the upper annular diaphragm 9 is larger than the lower diaphragm 9.

The basic embodiment of the magnet system unit 4 is comparable to the embodiments described previously, with the result that reference can be made to the statements in that regard.

The compression chamber 8 of the upper magnet system unit 4 is connected guided via channels A5 to the collecting space 11, which is bounded by the outer wall of the sound guidance body 13 and by walls of the magnet system unit 4. By contrast, the compression chamber 8 of the lower magnet system unit 4 is open at the top and opens directly into the collecting space 11.

The conically tapering sound guidance body 13 in the region of the collecting space 11 and the annular collecting space 11, which is inclined and tapers upward in part in the direction of the sound entry start 16, are used to tune the sound paths of the frequency ranges, which differ by virtue of the different diameters of the diaphragms 9, such that a correct-phase annular wavefront is produced. This wavefront, having an adjusted phase angle, is then transferred from the rotationally symmetric cross section to the slot-like cross section in the sound discharge channel 12 by using an appropriate contour—already described previously—of the sound guidance body 13 over at least part of the length of the sound wave routing element 14.

Figure 5B:
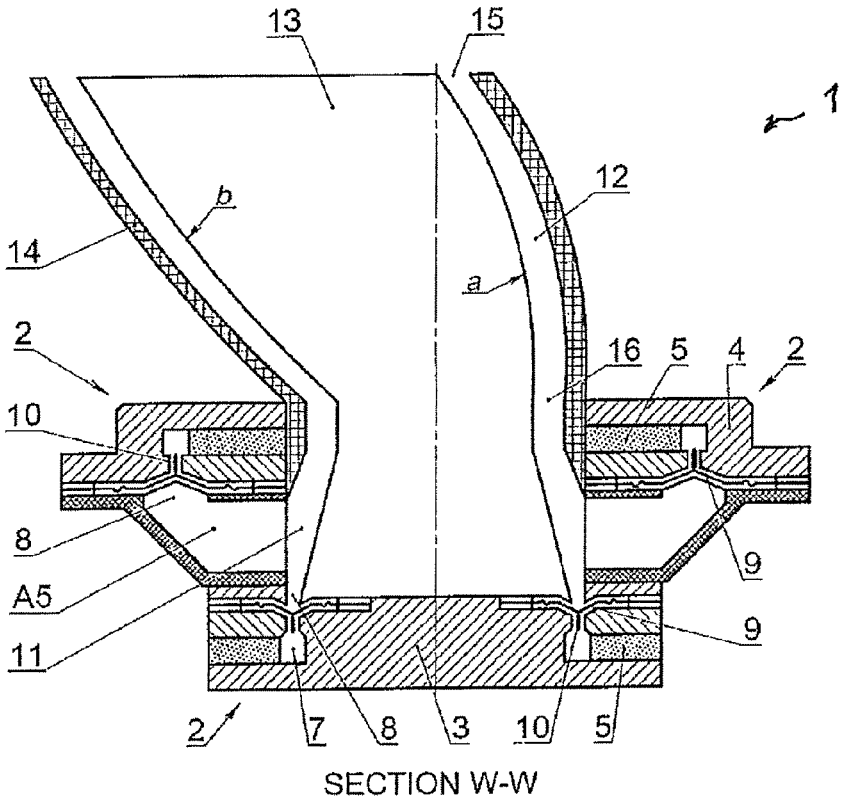
FIG. 5*b*)—shows a cross-sectional view of the annular diaphragm compression driver from FIG. 5*a*)

FIG. 5*b*) shows an embodiment of the sound wave routing element 14 with the sound guidance body 13, said embodiment also being able to be used, in principle, in conjunction with the compression drivers described previously and subsequently. In this case, the circumferential walls of the sound wave routing element 14 and accordingly the outer walls of the sound wave routing element 14 are of curved design with a radius a and b for the mutually opposite walls of the sound wave routing element. If the radius a is equal to the radius b, the sound wave at the sound exit end 15 is flat, i.e. the dispersion angle is 0°. A radius a>b results in a concave wavefront at the sound exit end, and a radius a<b results in a convex wavefront or a rise in vertical angle.

Figure 5C:
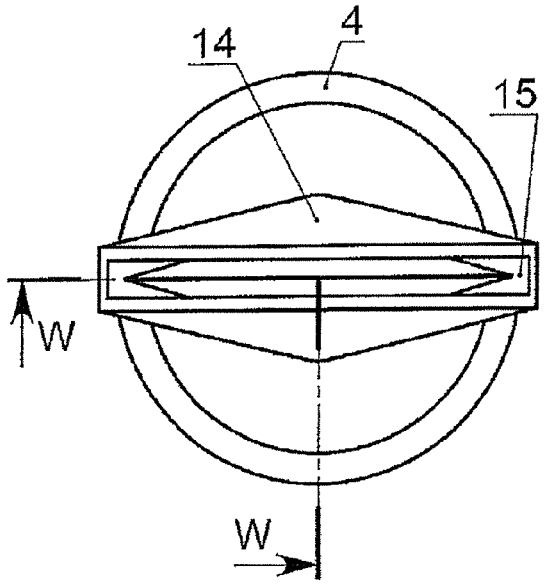
FIG. 5*c*)—shows a front view of the annular diaphragm compression driver from FIG. 5*a*)

This can in turn be seen more clearly from the plan view from FIG. 5*c*), which approximately corresponds to the cross sections already described above for the other embodiments.

Figure 5D:
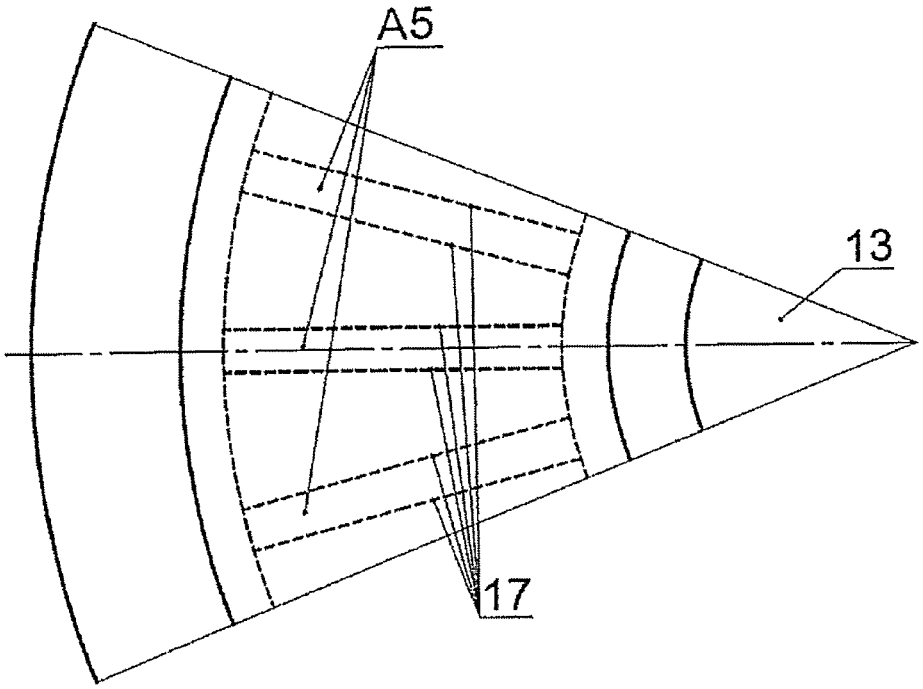
FIG. 5*d*)—shows a partial sectional view through the annular diaphragm compression driver in the region of the channels.

FIG. 5*d*) shows a partial sectional view through the channels A5. These are again delimited from one another by partitions 17, with the result that a multiplicity of separate, radially running channels A5 are in a distributed arrangement over the perimeter.

Figure 6A:
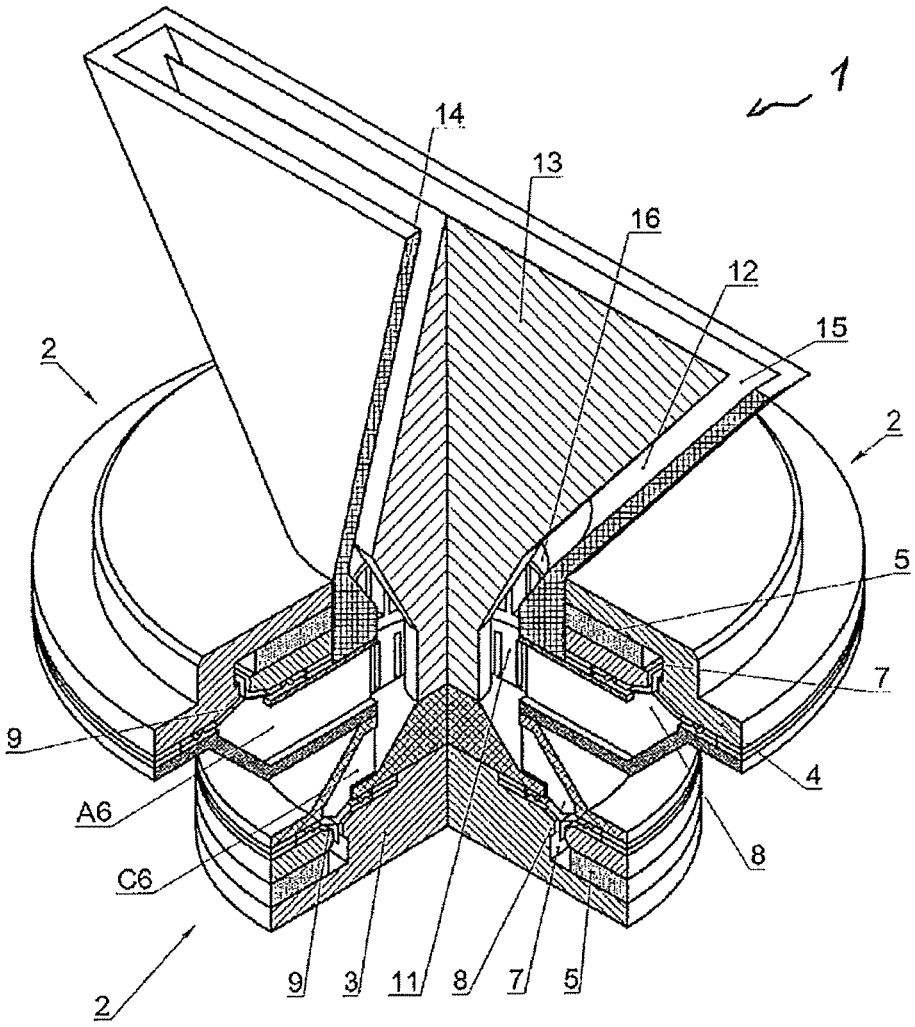
FIG. 6*a*)—shows a perspective view of a sixth embodiment of an annular diaphragm compression driver.
Figure 6B:
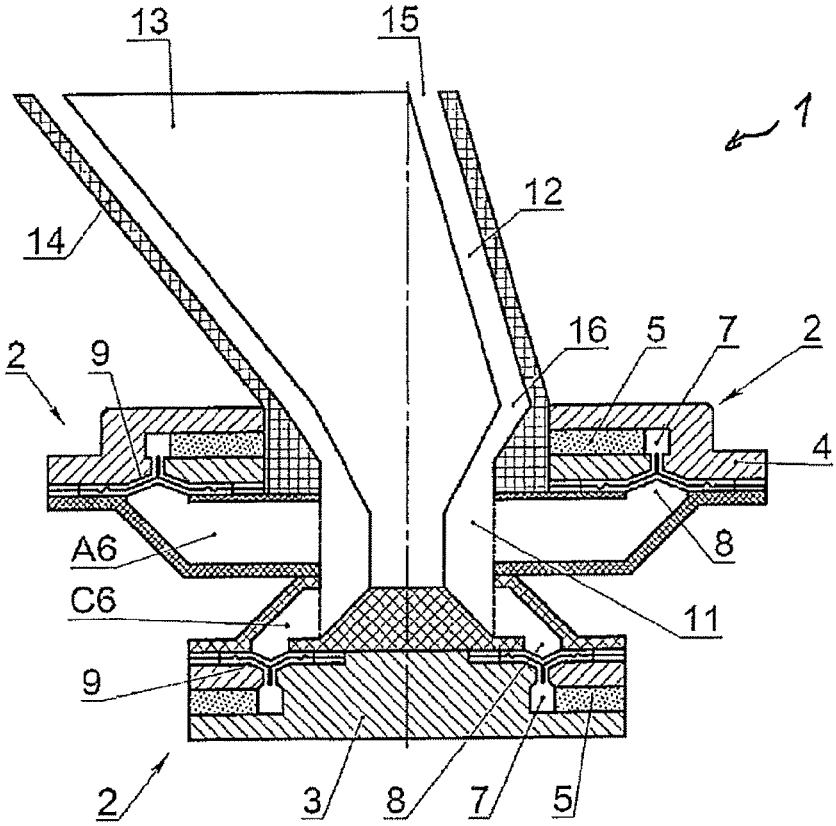
FIG. 6*b*)—shows a cross-sectional view of the annular diaphragm compression driver from FIG. 6*a*)

FIGS. 6*a*) to 6*d*) show a sixth embodiment of an annular diaphragm compression driver 1. In this embodiment, two magnet system units 4 having respective fitted annular diaphragms 9 are arranged above one another. In these magnet system units 4, a respective annular diaphragm 9 is held so as to be able to move in a respective compression chamber 8 in the manner described above. The upper annular diaphragm 9 has a larger diameter than the lower diaphragm 9.

In the embodiment shown, the magnet system units can be designed as separate housing parts which are screwed or welded to one another. It can be seen that the channels A6 of the upper magnet system unit 4 from the upper compression chamber 8 to the collection space 11 are arranged above the lower channels C6 from the lower compression chamber 8 of the lower magnet system unit 4. The combination, mixing and propagation time adjustment of the sound waves produced by the upper and lower magnet system units are performed in the collecting space 11. In the region of the collecting space 11, the diameter of the sound guidance body 13 which bounds the collecting space 11 is constant in part. Adjoining this constant portion, the diameter of the sound guidance body 13 tapers conically as far as a region at which the rotationally symmetric cross portion of the conically tapering portion of the sound guidance body 13 is transferred (e.g. linearly) to a cross section which matches the slot-like cross section.

Figure 6C:
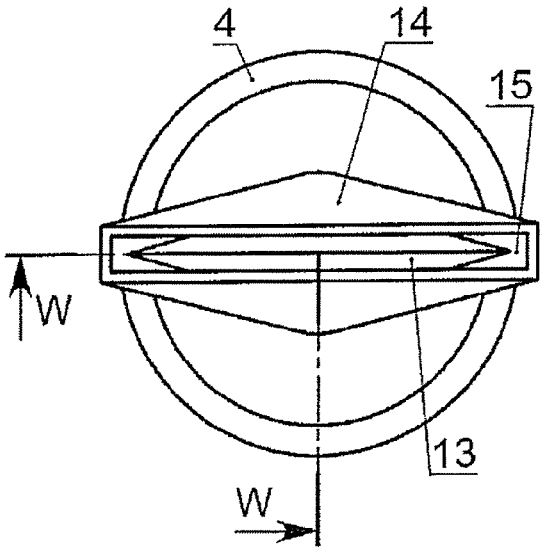
FIG. 6*c*)—shows a front view of the annular diaphragm compression driver from FIG. 6*a*)

This can in turn be seen more clearly from the plan view from FIG. 6*c*).

Figure 6D:
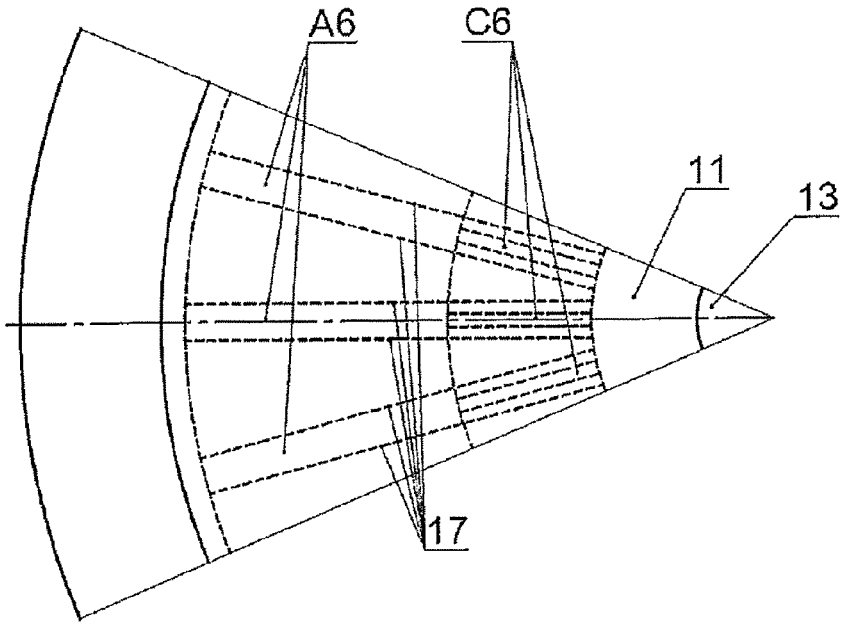
FIG. 6*d*)—shows a partial sectional view through the annular diaphragm compression driver in the region of the channels.

FIG. 6*d*) shows a sectional view in the region of the channels A6 and C6 of the upper and lower magnet system units 4. The channels A6 and C6 are in turn delimited from one another by partitions 17. They extend radially from the respective external compression chamber 8 to the internal collecting space 11.

It can be seen that, in the exemplary embodiment shown, the upper channels A6 and lower channels C6 are arranged above one another. This manages to provide a larger number of channels A6 and C6. This has the advantage that a larger air volume can be transported.

It can also be seen that the lower channels C6 of the lower magnet system unit 4 of smaller diameter have a lesser width than the upper channels A6 of the upper magnet system unit 4 of larger diameter. The reason for this is that the lower magnet system unit 4 is designed for higher frequencies than the upper magnet system unit 4 of larger diameter. The length, width and contour of the channels match these frequency ranges.

Figure 7A:
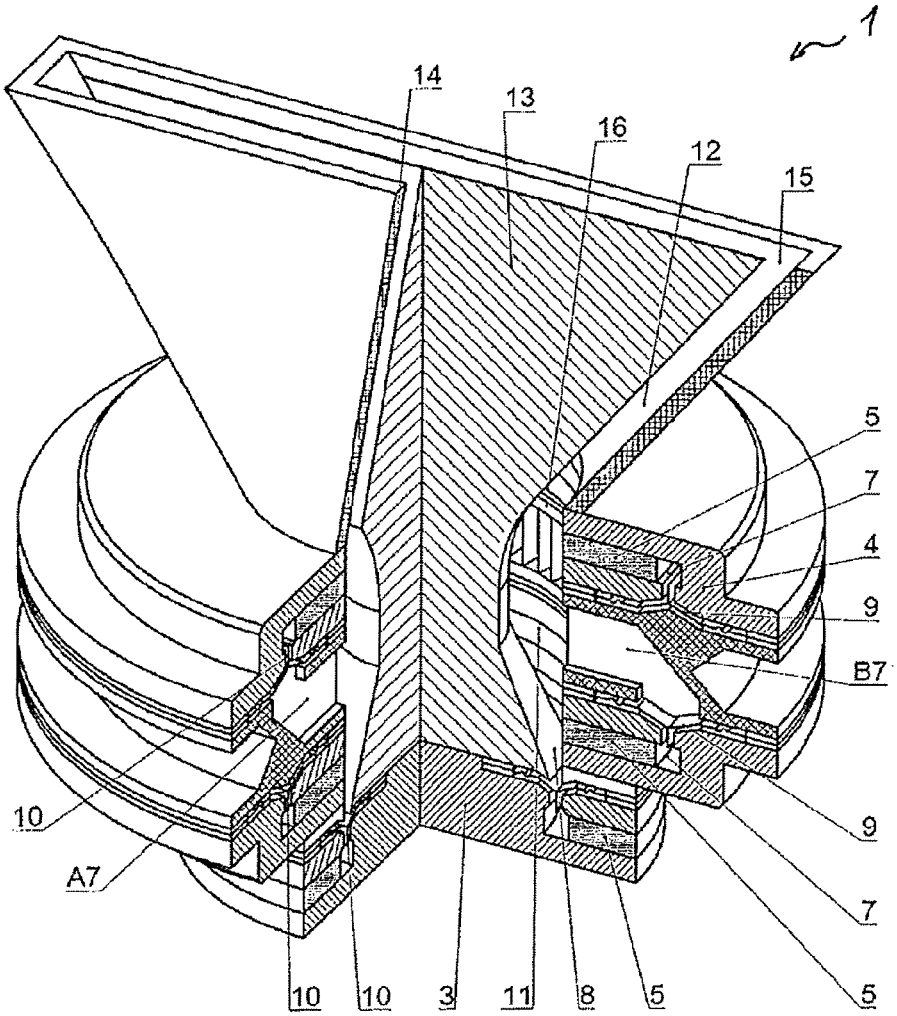
FIG. 7*a*)—shows a perspective view of a first embodiment of an annular diaphragm compression driver.
Figure 7B:
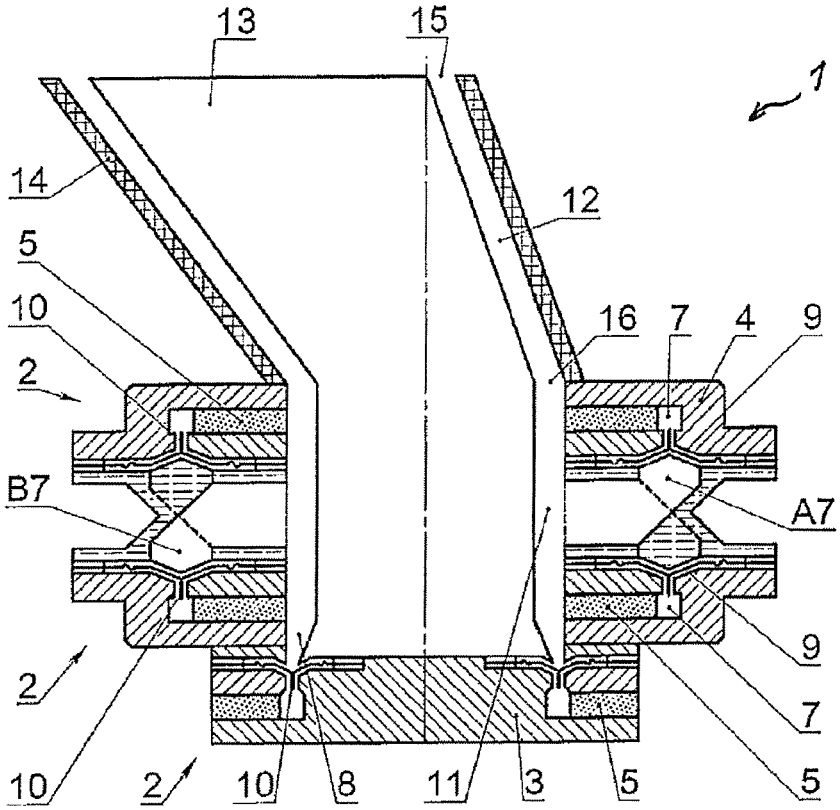
FIG. 7*b*)—shows a cross-sectional view of the annular diaphragm compression driver from FIG. 7*a*)

FIGS. 7*a*) to 7*d*) show a seventh embodiment of the annular diaphragm compression driver 1, in which in principle the third embodiment having two magnet system units 4 situated above one another is combined with the sixth embodiment having an underlying further magnet system unit of smaller diameter.

Equally, a combination of the fourth embodiment and the sixth embodiment is also conceivable. For the configuration of the upper two magnet system units 4, situated above one another, with the channels A7 and B7, reference is made to the comments relating to FIGS. 3*a*) to 3*d*).

It can be seen that the cross section of the collecting space first of all tapers conically from the lower region adjoining the lower compression chamber of the third magnet system unit 4 in the lower region and is then constant. The upper end of the collecting space 11 with a constant cross section then merges into the sound discharge channel 12, in which the annular, preferably rotationally symmetric cross section is then matched to the slot-like cross section in the manner described above. The direct introduction of the lower compression chamber into the collecting space 11 and the guidance and propagation time delay through the channels A7 and B7 for the upper two magnet system units 4 can be used to match the phase angle in relation to the frequencies of the upper two compression chambers 2 and the higher frequencies of the lower magnet system unit 4.

The annular wavefront at the upper output of the collecting space 11 is then matched to the slot-like exit end by using the contour of the sound discharge channel 12.

Figure 7C:
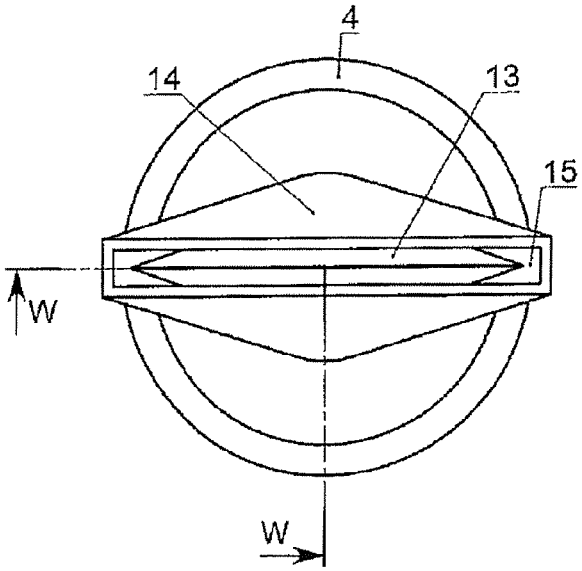
FIG. 7*c*)—shows a front view of the annular diaphragm compression driver from FIG. 7*a*)

FIG. 7*c*) in turn shows a plan view of the pressure chamber driver from FIGS. 7*a*) and 7*b*). In this case, it can be seen, in the manner already described in detail above, that the annular, e.g. oval, round, elliptical or polygonal, or any other rotationally symmetric contour at the sound entry start is transferred to a slot-like contour at the sound exit end 15.

Figure 7D:
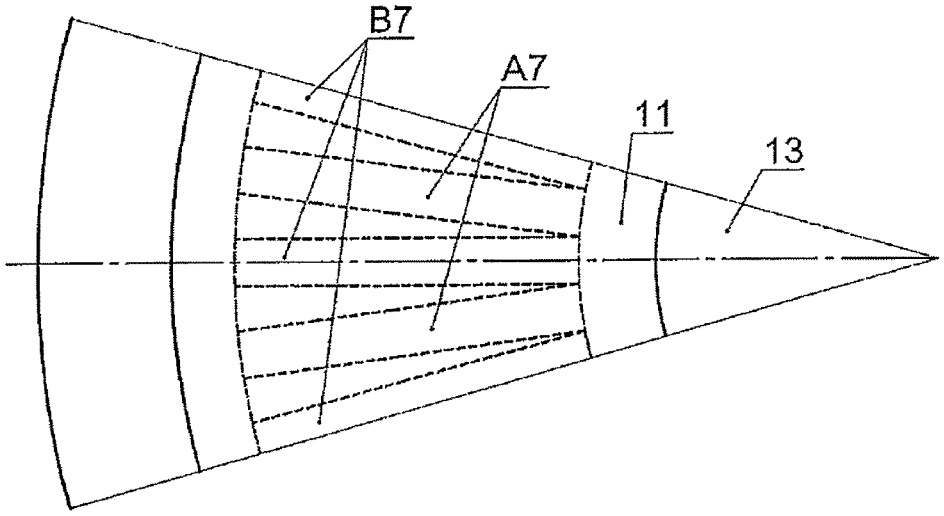
FIG. 7*d*)—shows a partial sectional view through the annular diaphragm compression driver in the region of the channels.

FIG. 7*d*) shows a cross-sectional view of the seventh embodiment of the pressure chamber driver 1 from FIGS. 7*a*) to 7*c*).

In this case, it can be seen that the channels A7 and B7 of the upper two magnet system units 4 situated above one another and having the same diameter are arranged alternately with one another. This corresponds to the configuration shown in FIG. 3*c*).

In contrast to FIG. 3*d*), it is evident that the selection of the sound guidance body 13 has a circumferential oblique wall in the region below the transition of the channels A7 and B7 to the collecting space 11 in the radially inner region. This then leads to the underlying compression chamber 8 of the lower, third magnet system unit 4.

The invention claimed is:

1. Annular diaphragm compression driver for a horn loudspeaker for electro-acoustic conversion comprising:

an annular diaphragm, which bears at least one moving coil, a compression driver housing having a closed housing base, a sound wave routing element opposite said housing base, said sound wave routing element having a sound discharge channel which is open at the end, and at least one annular magnet system unit, which has an annular magnet gap and at least one compression chamber adjoining said at least one magnet gap; for an associated annular diaphragm, wherein an open sound exit end of said sound discharge channel is in slot form adapted to be connected to a horn and a sound entry start of the sound discharge channel, which sound entry start is opposite the open sound exit end and adjacent to said at least one compression chamber, is annular, and the sound path between the said at least one compression chamber and said sound entry start of said sound discharge channel contains an annular collecting space, wherein said annular collecting space and said sound discharge channel contain a central sound guidance body having a portion which merges from an annular cross section into a linear cross section which matches the slot form of said sound exit end of said sound discharge channel, and said sound discharge channel is formed between said sound guidance body and a circumferential wall of said sound wave routing element, and wherein said circumferential outer wall of said central sound guidance body forms an inner wall of the collecting space and an inner wall of said sound discharge channel.

2. Annular diaphragm compression driver according to claim 1, wherein said at least one compression chamber opens into the collecting space via a radially circumferential channel.

3. Annular diaphragm compression driver according to claim 1, wherein said at least one compression chamber opens into the collecting space via a multiplicity of channels bounded by side walls.

4. Annular diaphragm compression driver according to claim 1, wherein two compression chambers having associated annular magnet system units are arranged above one another such that moving coils of two diaphragms held in the respective compression chambers point away from one another, and the compression chambers open into a common collecting space via channels or slots which are delimited from one another.

5. Annular diaphragm compression driver according to claim 4, comprising a further compression chamber having an annular third magnet system unit arranged adjacent to said housing base, wherein the compression chamber of said third magnet system unit opens directly into said annular collecting space.

6. Annular diaphragm compression driver according to claim 1, wherein said annular collecting space is annular over its entire length, and said sound guidance body is annular over its length which is situated within said collecting space.

7. Annular diaphragm compression driver according to claim 1, said sound exit end which is open in slot form has a cross section which is rectangular or in the form of a biconvex lens or elliptical.

8. Annular diaphragm compression driver according to claim 1, wherein at least two compression chambers having associated annular diaphragms are provided, and diameters of at least two diaphragms are different from one another.

9. Annular diaphragm compression driver according to claim 1, said collecting space has a tapering or widening portion.

10. Annular diaphragm compression driver according to claim 1, said collecting space is divided into segments by partitions.

* * * * *